US008378592B2

(12) United States Patent
Chou et al.

(10) Patent No.: US 8,378,592 B2
(45) Date of Patent: Feb. 19, 2013

(54) END OF LAMP LIFE PROTECTION CIRCUIT WITH BI-LEVEL DETECTIONS FOR THE ELECTRONIC BALLAST AND METHOD THEREOF

(75) Inventors: Ching-Ho Chou, Taipei (TW); Yung-Chuan Lu, Taipei (TW); Edy Chandra, Taipei (TW); Chao-Wei Tsai, Taipei (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 281 days.

(21) Appl. No.: 12/980,449

(22) Filed: Dec. 29, 2010

(65) Prior Publication Data

US 2011/0156592 A1 Jun. 30, 2011

(30) Foreign Application Priority Data

Dec. 31, 2009 (TW) ..... 98146628 A

(51) Int. Cl.
*H05B 37/02* (2006.01)

(52) U.S. Cl. ..... 315/307; 315/224; 315/DIG. 7

(58) Field of Classification Search ..... 315/291, 315/224, 307, 308, DIG. 2, DIG. 5, DIG. 7, 315/209 R See application file for complete search history.

(56) References Cited

U.S. PATENT DOCUMENTS

| | | | | |
|---|---|---|---|---|
| 6,429,603 | B1 * | 8/2002 | Tsugita et al. | 315/224 |
| 7,288,901 | B1 * | 10/2007 | Yu et al. | 315/291 |
| 2004/0113566 | A1 * | 6/2004 | Nemirow | 315/291 |

* cited by examiner

*Primary Examiner* — David H Vu
(74) *Attorney, Agent, or Firm* — Gottlieb, Rackman & Reisman, P.C.

(57) ABSTRACT

The configurations of an end of lamp life protection circuit for a ballast and a method thereof are provided in the present invention. The proposed circuit includes a voltage-dividing circuit receiving an input voltage and outputting a first and a second divided voltages and a switch apparatus raising the first divided voltage when the second divided voltage is less than a first pre-determined threshold value and turning off the ballast when the first divided voltage is higher than a second pre-determined threshold value.

19 Claims, 16 Drawing Sheets

| Product Ordering Code | Length (mm) | Nominal Watts | LPW | Product Description | Case Qty | Lumens Initial | Lumens Mean | Life (Hrs.) | T5 Lamp parameter |
|---|---|---|---|---|---|---|---|---|---|
| 39964 | 549 | 14 | 96 | F14W/T5/HE/830 | 40 | 1350 | 1269 | 20,000 | |
| 39961 | 549 | 14 | 96 | F14W/T5/HE/835 | 40 | 1350 | 1269 | 20,000 | 82V_170mA |
| 39973 | 549 | 14 | 96 | F14W/T5/HE/841 | 40 | 1350 | 1269 | 20,000 | |
| | | | | | | | | | |
| 39976 | 849 | 21 | 100 | F21W/T5/HE/830 | 40 | 2100 | 1974 | 20,000 | |
| 39977 | 849 | 21 | 100 | F21W/T5/HE/835 | 40 | 2100 | 1974 | 20,000 | 123V_170mA |
| 39978 | 849 | 21 | 100 | F21W/T5/HE/841 | 40 | 2100 | 1974 | 20,000 | |
| | | | | | | | | | |
| 39982 | 1149 | 28 | 104 | F28W/T5/HE/830 | 40 | 2900 | 2726 | 20,000 | |
| 39983 | 1149 | 28 | 104 | F28W/T5/HE/835 | 40 | 2900 | 2726 | 20,000 | 167V_170mA |
| 39984 | 1149 | 28 | 104 | F28W/T5/HE/841 | 40 | 2900 | 2726 | 20,000 | |
| | | | | | | | | | |
| 39989 | 1449 | 35 | 104 | F35W/T5/HE/830 | 40 | 3650 | 3431 | 20,000 | |
| 39990 | 1449 | 35 | 104 | F35W/T5/HE/835 | 40 | 3650 | 3431 | 20,000 | 209V_170mA |
| 39991 | 1449 | 35 | 104 | F35W/T5/HE/841 | 40 | 3650 | 3431 | 20,000 | |

Fig. 1(a)(Prior Art)

| Description_$T_2$ Lamp | 6W | 8W | 11W | 13W | 21W | 23W | Unit |
|---|---|---|---|---|---|---|---|
| Lamp retted wattage | 5 | 8 | 11 | 13 | 20.5 | 22.5 | W |
| Lamp operating voltage | 51 | 79 | 110 | 133 | 210 | 230 | Vrms |
| Lamp current | 100 | 100 | 100 | 100 | 100 | 100 | mA |

Fig. 1(b)(Prior Art)

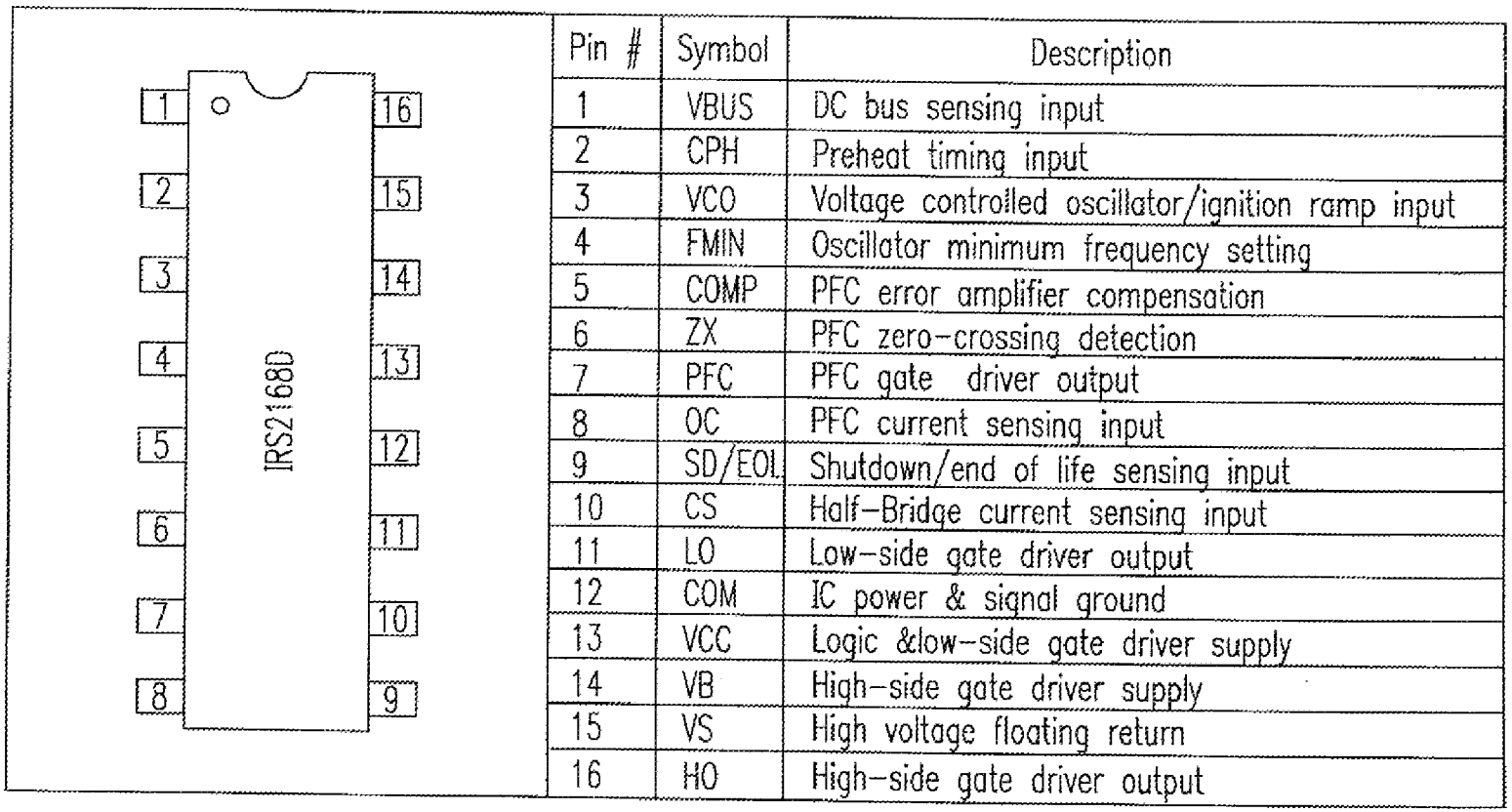

| Pin # | Symbol | Description |
|---|---|---|
| 1 | VBUS | DC bus sensing input |
| 2 | CPH | Preheat timing input |
| 3 | VCO | Voltage controlled oscillator/ignition ramp input |
| 4 | FMIN | Oscillator minimum frequency setting |
| 5 | COMP | PFC error amplifier compensation |
| 6 | ZX | PFC zero-crossing detection |
| 7 | PFC | PFC gate driver output |
| 8 | OC | PFC current sensing input |
| 9 | SD/EOL | Shutdown/end of life sensing input |
| 10 | CS | Half-Bridge current sensing input |
| 11 | LO | Low-side gate driver output |
| 12 | COM | IC power & signal ground |
| 13 | VCC | Logic &low-side gate driver supply |
| 14 | VB | High-side gate driver supply |
| 15 | VS | High voltage floating return |
| 16 | HO | High-side gate driver output |

Fig. 2(Prior Art)

END OF LAMP LIFE PROTECTION CIRCUIT WITH BI-LEVEL DETECTIONS FOR THE ELECTRONIC BALLAST AND METHOD THEREOF

FIELD OF THE INVENTION

The present invention relates to an electronic ballast. More particularly, it relates to an electronic ballast having an end of lamp life protection circuit with bi-level detecting signals and method thereof.

BACKGROUND OF THE INVENTION

A new design of florescent lamp will consider the consistency of lamp current for lamps having various powers (see FIGS. 1(*a*)-1(*b*)) and cooperate with the operational scheme of electronic type ballast having constant current so as to realize an electronic ballast being collocated with a series of various lamps.

According to the safety regulation of IEC61347-2-3, electronic ballasts must have an end of lamp life protection function to avoid the melting of the lamp socket caused by the over-heating of the filament so as to cause an indoor fire. The currently existing specified control IC for electronic ballast could provide the end of lamp life protection function, e.g., the IC IRS2168DSPbF of the International Rectifier Corp. (see FIG. 2). When the detecting voltage of the SD/EOL pin is higher than 3V or lower than 1V, this IC will enter the protection mode and cease the operation. The operational voltages of Lamps having various powers are different from one another. For example, the lamp voltage of T5 5-foot 35 W florescent tube is 209V, and the lamp voltage of T5 2-foot 14 W florescent tube is 82V. Under the circumstances of using the single specification of electronic ballasts in the operations, the detecting voltages at the SD/EOL pins of lamps with the same current and various powers at the end of life are different from one another. The detecting voltage satisfies the design requirements of a 35 W lamp will result in that a 14 W lamp fails to enter its protection mode so as to cease its operation. This is the common quality problem of the electronic ballasts in the commercial market.

Base on the above-mentioned considerations, the present invention is aimed at developing the technology for an applicable electronic ballast having end of lamp life protection circuit with bi-level detecting signal to improve the quality of the electronic ballast to avoid the melting of the lamp socket caused by the over-heating of the filament so as to cause a fire.

When a single electronic ballast is used to drive lamps having various powers or in the applications of multiple florescent tubes connected in series, the end of lamp life protection circuit having a single detecting signal can not fulfill all the applications of various lamp loads such that the end of lamp life protection functions are not complete. Refer to the single tube application circuit IRS2168DSPbF of the International Rectifier Corp. (see FIG. 3, wherein AC+ is the positive terminal of the rectified AC power line, and AC− is the negative terminal of the rectified AC power line), one could know that there will be high voltage generated across Cres in the series-connected resonant circuit when the 35 W lamp is abnormal and a detecting potential is generated across Ceol after the voltage is divided via resistors R5, R6, R8, and R9, D3 is turned on to charge Csd when this detecting potential is higher than the breakdown voltage of D3. The IC will enter the protection mode and cease the operation when the potential across Csd is larger than 3V. But when the lamp is changed to a T5 14 W lamp tube, the potential of Csd is impossible to be larger than 3V under the same condition, and the electronic ballast keeps in operation will have a hidden trouble regarding quality.

FIG. 4 is a circuit diagram showing the application of an IC ST L6585D and two T5 35 W lamps connected in series (wherein E1 and E2 are lamp tubes). One could know that the single terminal of the filament will emit the electrons when the lamp tube is abnormal, and a high voltage across C15 of the series-connected resonant circuit will be generated, and a bias will be generated across the DC blocking capacitor C18, a detecting potential will be generated across C17 after the voltage is divided via the resistors R40, R30, R31 and R33, and the IC will enter the protection mode and cease the operation when this detecting potential is larger than 3.22V. But when the lamp is changed to two T5 14 W lamp tubes connected in series, the potential of C17 is impossible to be larger than 3.22V under the same condition, and the electronic ballast keeps in operation will have a hidden trouble regarding quality.

The application circuit of the two T5 35 W lamps connected in series as shown in FIG. 4 could be further changed to a single T5 35 W lamp tube or a single T5 14 W lamp tube, and the preheating circuit of the two lamp tubes connected in series (L1C and C24) is open-circuited. The potential of C17 is impossible to be larger than 3.22V under the same condition, and the electronic ballast keeps in operation will have a hidden trouble regarding quality.

FIG. 5 is a circuit diagram of an application circuit of four T5 14 W lamp tubes having an IC ICB1FL02G of Infineon Technologies using dual resonant circuit with two lamp tubes connected in series. When this circuit is applied to three T5 14 W lamp tubes, the electronic ballast keeps in operation will have a hidden trouble regarding quality.

In the prior art as shown in FIG. 6, it discloses the end of lamp life protection circuit (wherein, W is an inverter, A is a shut-off device, SR is a step-up regulator, FC is a firing circuit, and E1 and E2 are lamp tubes), a high voltage detecting signal is taken from the resonant circuit, and the ballast will cease the operation when the detecting voltage is higher than the operating point. The drawbacks of the prior art are that the end of lamp life protection circuit having a single detecting signal can not fulfill all the applications of various lamp loads.

Keeping the drawbacks of the prior arts in mind, and employing experiments and research full-heartily and persistently, the applicant finally conceived an end of lamp life protection circuit with bi-level detections for the electronic ballast and a method thereof.

SUMMARY OF THE INVENTION

It is therefore an object of the present invention to provide an electronic ballast having an end of lamp life protection circuit with bi-level detecting signal to improve the quality of the electronic ballast to avoid the melting of the lamp socket caused by the over-heating of the filament so as to prevent a fire.

According to the first aspect of the present invention, an end of lamp life protection circuit configured in a ballast comprises a voltage-dividing circuit having an input terminal receiving an input voltage, a first output terminal outputting a first divided voltage and a second output terminal outputting a second divided voltage, and a switch apparatus raising the first divided voltage when the second divided voltage is less than a first predetermined threshold value and turning off the ballast when the first divided voltage is higher than a second predetermined threshold value.

Preferably, the voltage-dividing circuit further comprises a first, a second, a third, a fourth and a fifth resistors and a first voltage-dividing route, the switch apparatus comprises a switch and the first resistor, the switch is turned off such that the first voltage-dividing route is electrically connected to the input terminal, the third resistor, the first output terminal, the second resistor, the first resistor and a grounded terminal in series so as to raise the first divided voltage when the second divided voltage is smaller than the first predetermined threshold value, and the switch is turned on and the first resistor is short-circuited such that the first voltage-dividing route is electrically connected to the input terminal, the third resistor, the first output terminal, the second resistor and the grounded terminal so that the first divided voltage is prohibited being raised when the second divided voltage is not smaller than the first predetermined threshold value.

Preferably, the voltage-dividing circuit further comprises a second voltage-dividing route electrically connected to the input terminal, the fourth resistor, the second output terminal, the fifth resistor and the grounded terminal in series for generating the second divided voltage, the switch comprises a first terminal coupled to the first and the second resistors, a second terminal coupled to the grounded terminal and a control terminal coupled to the second output terminal.

Preferably, the switch apparatus further comprises a control device coupled to the control terminal of the switch and the second output terminal, the control device is turned off so as to turn off the switch when the second divided voltage is smaller than the first predetermined threshold value, and the control device is turned on so as to turn on the switch when the second divided voltage is not smaller than the first predetermined threshold value.

Preferably, the control device is one of a zener diode and a DIAC, and the first predetermined threshold value is a breakdown voltage of one of the zener diode and the DIAC.

Preferably, the voltage-dividing circuit further comprises a first, a second, a third, a fourth and a fifth resistors and a first voltage-dividing route, the switch apparatus comprises a switch and the second resistor, the switch is turned off such that the first voltage-dividing route is electrically connected to the input terminal, the third resistor, the first output terminal, the first resistor and a grounded terminal in series so as to raise the first divided voltage when the second divided voltage is smaller than the first predetermined threshold value, and the switch is turned on such that the first voltage-dividing route is electrically connected to the input terminal, the third resistor, the first output terminal, the first and the second resistors connected to each other in parallel and the grounded terminal so that the first divided voltage is prohibited being raised when the second divided voltage is not smaller than the first predetermined threshold value.

Preferably, the voltage-dividing circuit further comprises a second voltage-dividing route electrically connected to the input terminal, the fourth resistor, the second output terminal, the fifth resistor and the grounded terminal in series for generating the second divided voltage, and the switch comprises a first terminal coupled to the second resistor, a second terminal coupled to the grounded terminal and a control terminal coupled to the second output terminal.

Preferably, the voltage-dividing circuit further comprises a first, a second, a third, a fourth, a fifth and a sixth resistors and a first voltage-dividing route, the switch apparatus comprises a switch and the first resistor, the switch is turned off such that the first voltage-dividing route is electrically connected to the input terminal, the sixth resistor, the third resistor, the first output terminal, the second resistor, the first resistor and a grounded terminal in series so as to raise the first divided voltage when the second divided voltage is smaller than the first predetermined threshold value, and the switch is turned on and the first resistor is short-circuited such that the first voltage-dividing route is electrically connected to the input terminal, the sixth resistor, the third resistor, the first output terminal, the second resistor and the grounded terminal so that the first divided voltage is prohibited being raised when the second divided voltage is not smaller than the first predetermined threshold value.

Preferably, the voltage-dividing circuit further comprises a second voltage-dividing route electrically connected to the input terminal, the sixth resistor, the fourth resistor, the second output terminal, the fifth resistor and the grounded terminal in series for generating the second divided voltage, the switch comprises a first terminal coupled to the first and the second resistors, a second terminal coupled to the grounded terminal and a control terminal coupled to the second output terminal.

Preferably, the voltage-dividing circuit further comprises a first, a second, a third, a fourth, a fifth and a sixth resistors and a first voltage-dividing route, the switch apparatus comprises a switch and the second resistor, the switch is turned off such that the first voltage-dividing route is electrically connected to the input terminal, the sixth resistor, the third resistor, the first output terminal, the first resistor and a grounded terminal in series so as to raise the first divided voltage when the second divided voltage is smaller than the first predetermined threshold value, and the switch is turned on such that the first voltage-dividing route is electrically connected to the input terminal, the sixth resistor, the third resistor, the first output terminal, the first and the second resistors connected to each other in parallel and the grounded terminal so that the first divided voltage is prohibited being raised when the second divided voltage is not smaller than the first predetermined threshold value.

Preferably, the voltage-dividing circuit further comprises a second voltage-dividing route electrically connected to the input terminal, the sixth resistor, the fourth resistor, the second output terminal, the fifth resistor and the grounded terminal in series for generating the second divided voltage, and the switch comprises a first terminal coupled to the second resistor, a second terminal coupled to the grounded terminal and a control terminal coupled to the second output terminal.

Preferably, the ballast further comprises a resonant circuit and a controller of the ballast, the input terminal is coupled to the resonant circuit, the switch apparatus comprises the controller of the ballast and the first output terminal coupled to the controller of the ballast, and the ballast is turned off via the controller of the ballast when the first divided voltage is higher than the second predetermined threshold value.

Preferably, the ballast further comprises a coupling circuit, a resonant circuit and a controller of the ballast, the input terminal is coupled to the coupling circuit coupled to the resonant circuit, the switch apparatus comprises the controller of the ballast and the first output terminal coupled to the controller of the ballast, and the ballast is turned off via the controller of the ballast when the first divided voltage is higher than the second predetermined threshold value.

Preferably, the ballast is an electronic ballast and configured in a specific florescent lamp, and the specific florescent lamp is one selected from a group consisting of a plurality of florescent lamps, each of which has an equal current value and a power value different from one another.

According to the second aspect of the present invention, a controlling method for an end of lamp life protection circuit configured in a ballast, wherein the end of lamp life protection circuit is operated under an input voltage, the method comprises the steps of: dividing the input voltage into a first and a second divided voltages; raising the first divided voltage when the second divided voltage is smaller than a first predetermined threshold value; and turning off the ballast when the first divided voltage is higher than a second predetermined threshold value.

Preferably, the ballast is operated under a protection mode when the first divided voltage is higher than the second predetermined threshold value.

Preferably, the raising the first divided voltage step further comprises the following steps: providing a voltage-dividing circuit having a resistor and a first and a second voltage-dividing routes and a switch apparatus having a switch and the resistor; turning off the switch to electrically connect the resistor and the first voltage-dividing route in series so as to raise the first divided voltage when the second divided voltage provided by the second voltage-dividing route is smaller than the first predetermined threshold value; and turning on the switch to short-circuit the resistor so that the first divided voltage is prohibited being raised when the second divided voltage is not smaller than the first predetermined threshold value.

Preferably, the raising the first divided voltage step further comprises the following steps: providing a controller of a ballast; and turning off the ballast via the controller of the ballast when the first divided voltage is higher than the second predetermined threshold value.

Preferably, the raising the first divided voltage step further comprises the following steps: providing a voltage-dividing circuit having a first and a second resistors and a first and a second voltage-dividing routes, and a switch apparatus having a switch and the second resistor; turning off the switch to electrically connect the first resistor and the first voltage-dividing route in series so as to raise the first divided voltage when the second divided voltage provided by the second voltage-dividing route is smaller than the first predetermined threshold value; and turning on the switch to electrically connect the first and the second resistors connected to each other in parallel and the first voltage-dividing route in series so that the first divided voltage is prohibited being raised when the second divided voltage is not smaller than the first predetermined threshold value.

The present invention may best be understood through the following descriptions with reference to the accompanying drawings, in which:

BRIEF DESCRIPTION OF THE DRAWINGS

FIGS. 1(*a*) and 1(*b*) respectively show the related data of T5 lamp tubes and T2 lamp tubes having the same current and various powers in the prior art;

FIG. 2 shows a schematic diagram of a specific control chip (IRS2168D) of a ballast and the related descriptions of its pins in the prior art;

DETAILED DESCRIPTION OF THE PREFERRED EMBODIMENT

Figure 3:
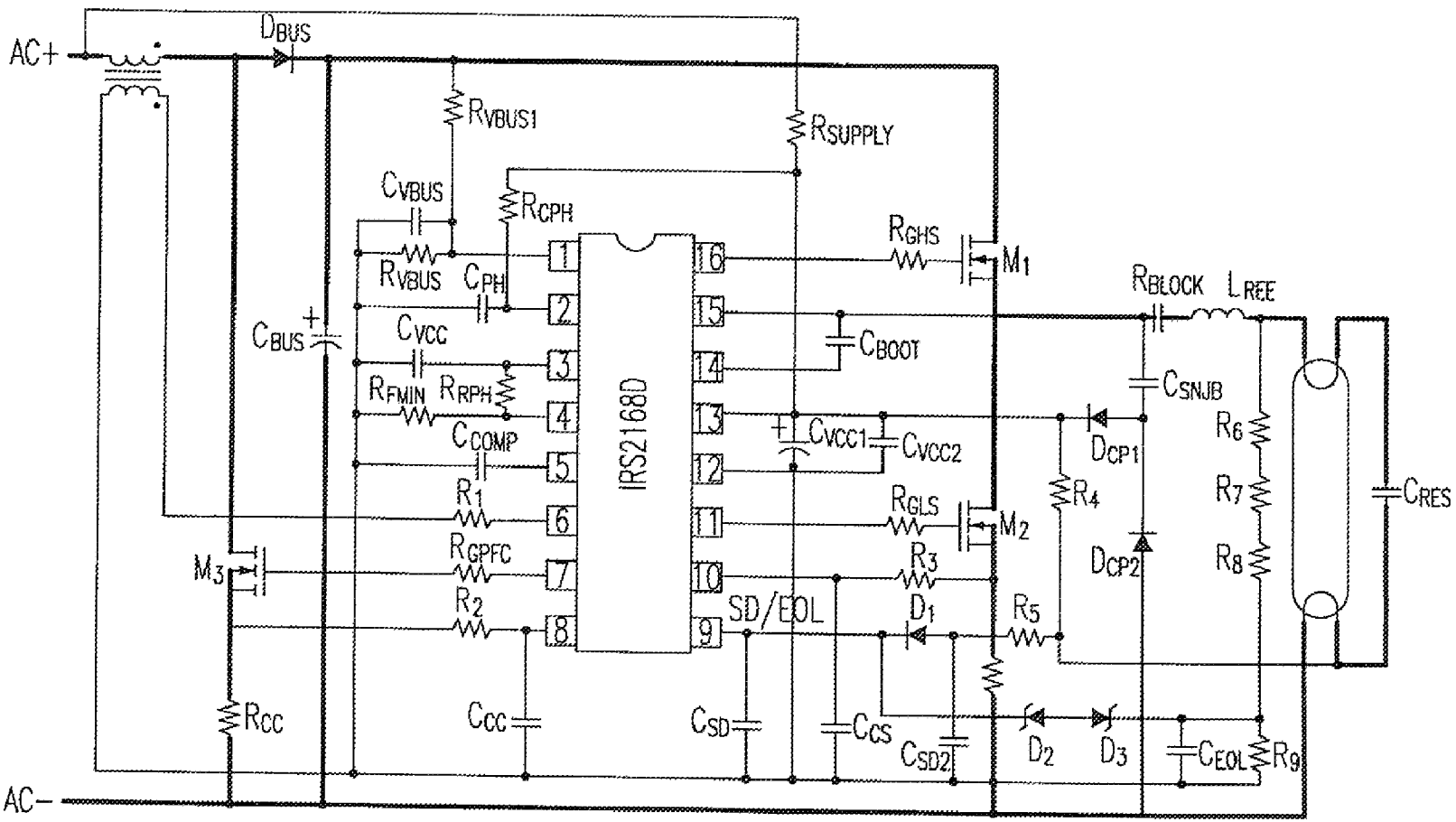
Fig. 3(Prior Art)
FIG. 3 shows a circuit diagram of an application circuit of a single lamp tube of a specific control chip (IRS2168D) of a ballast in the prior art.
Figure 4:
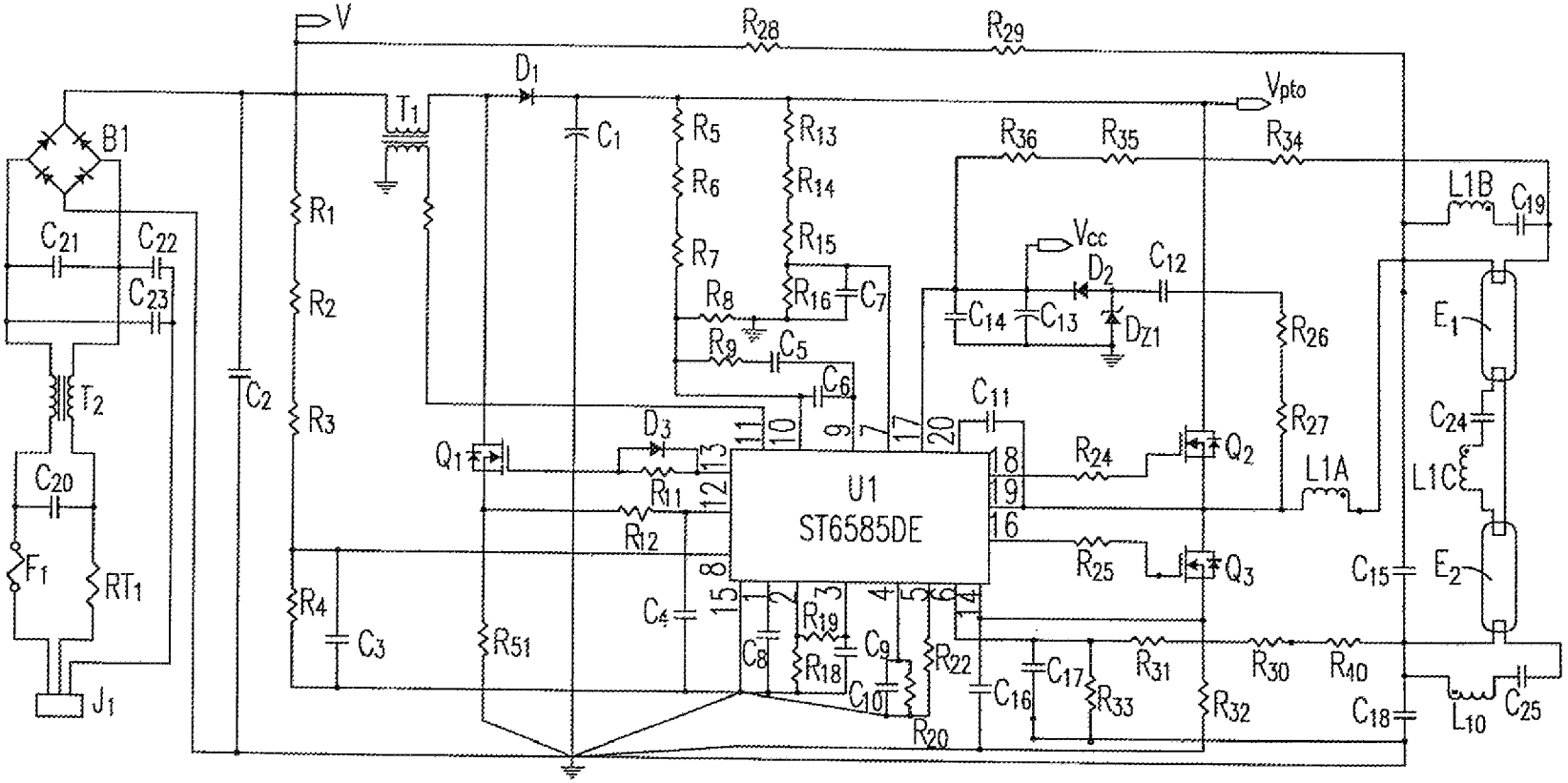
Fig. 4(Prior Art)
FIG. 4 shows a circuit diagram of an application circuit of an IC ST L6585D and two T5 35 W lamps connected in series in the prior art.
Figure 5:
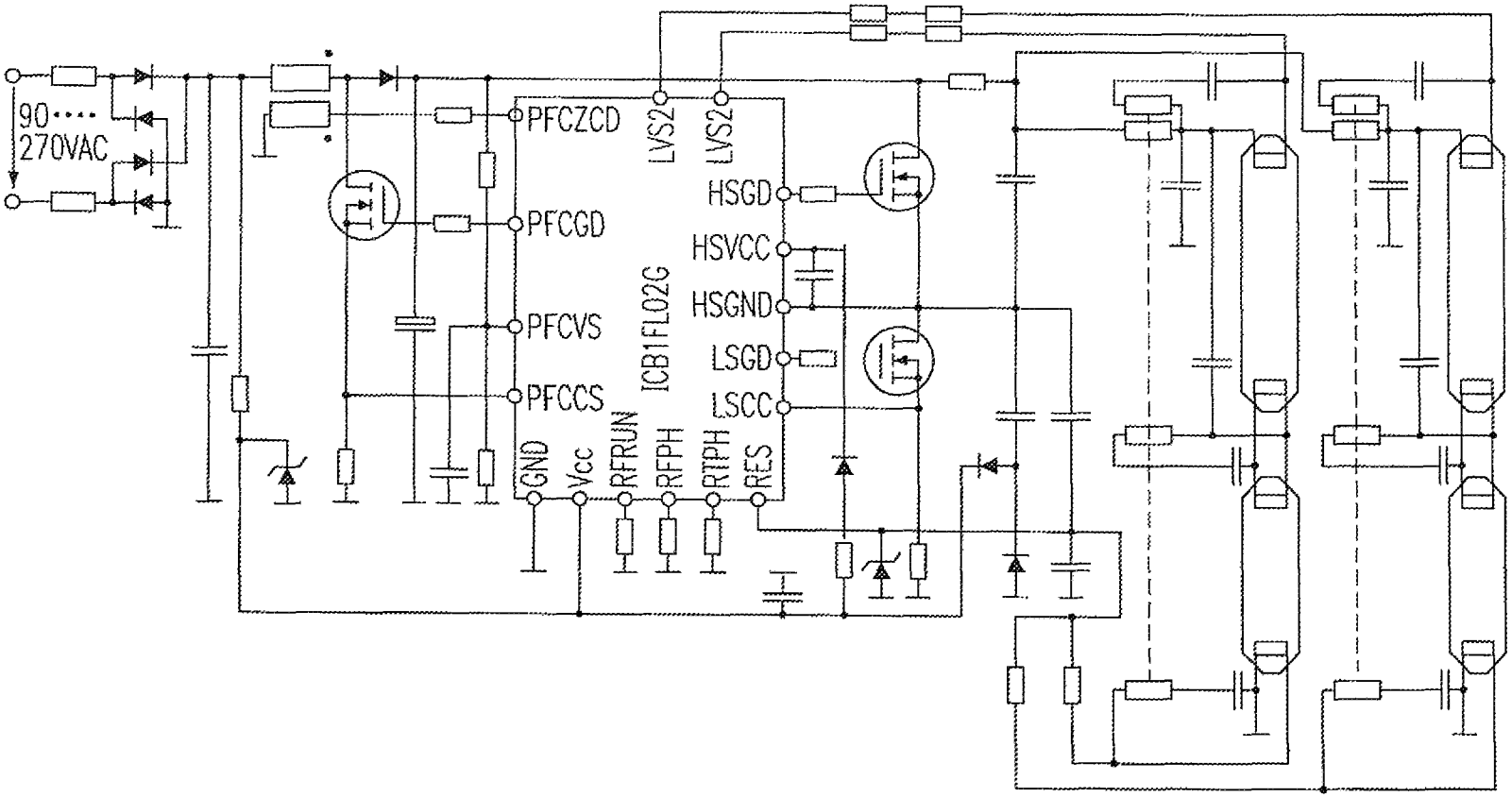
Fig. 5(Prior Art)
FIG. 5 shows a circuit diagram of an application circuit of four T5 14 W lamp tubes having an IC ICB1FL02G of Infineon Technologies and using dual resonant circuit with two lamp tubes connected in series.
Figure 6:
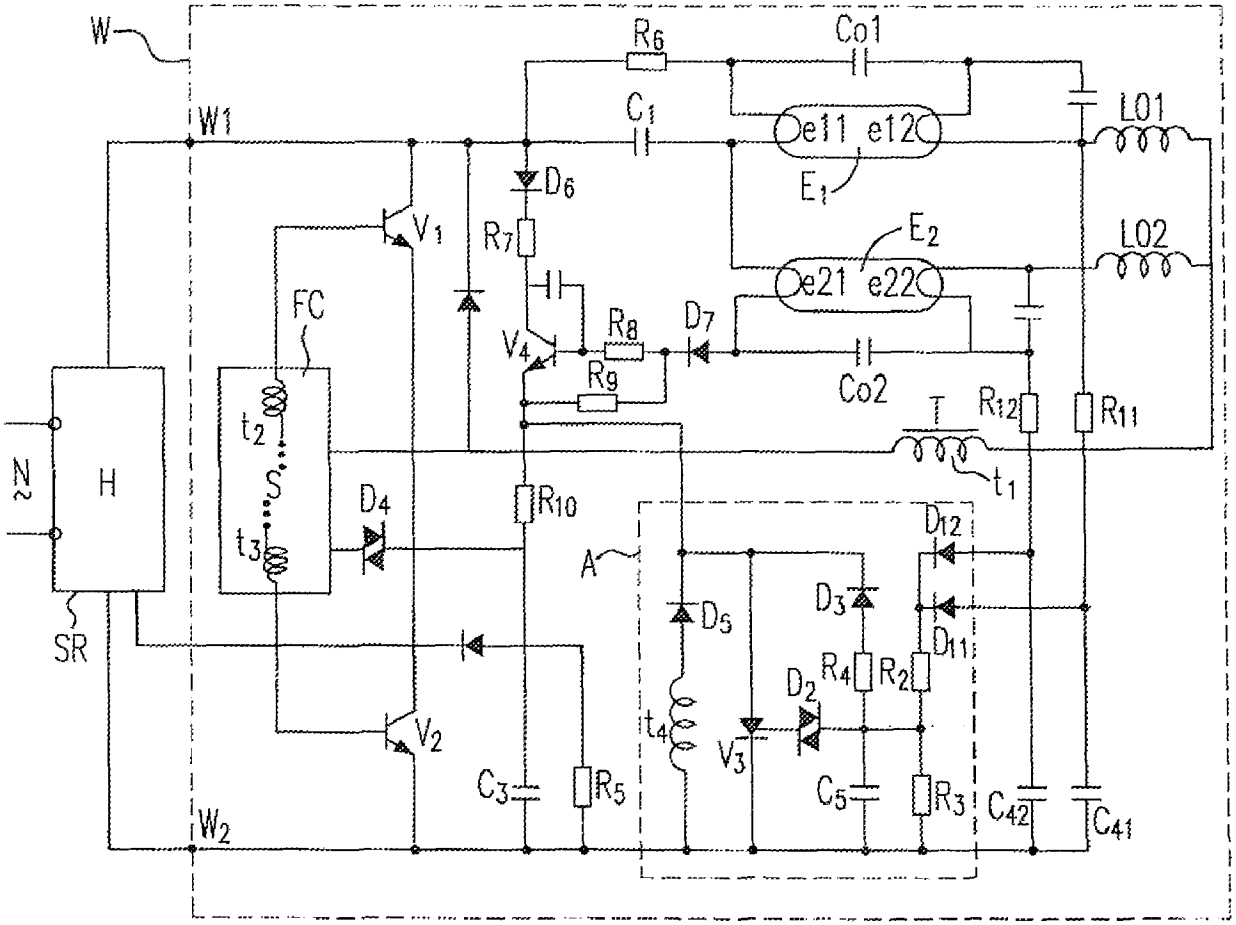
Fig. 6(Prior Art)
FIG. 6 shows a schematic circuit diagram of an end of lamp life protection circuit in the prior art.
Figure 7A:
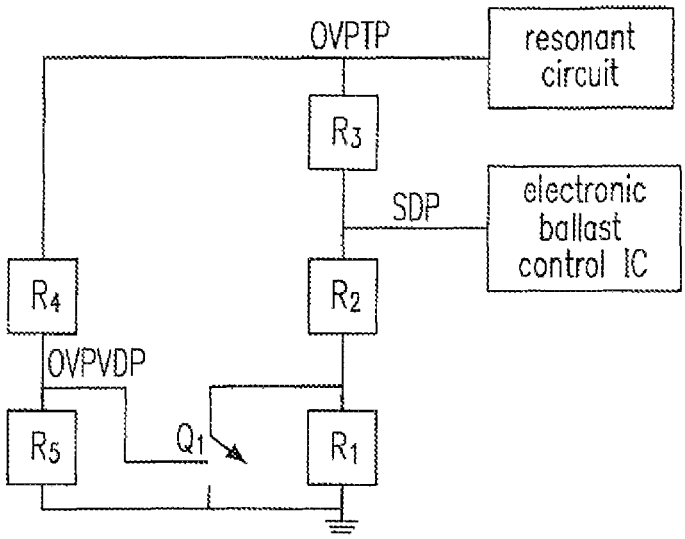
FIGS. 7(*a*) to 7(*h*) respectively show a schematic circuit diagram of an electronic ballast having an end of lamp life protection circuit with bi-level detecting signal according to the first to the eighth preferred embodiments of the present invention.
Figure 7B:
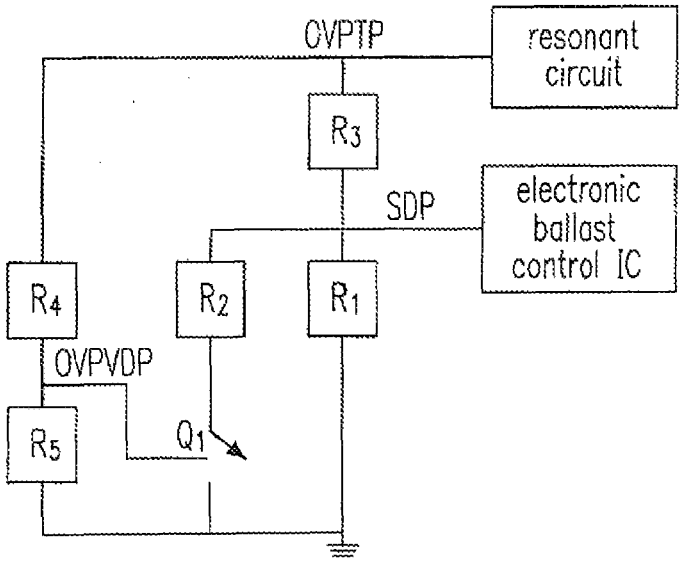
Figure 7C:
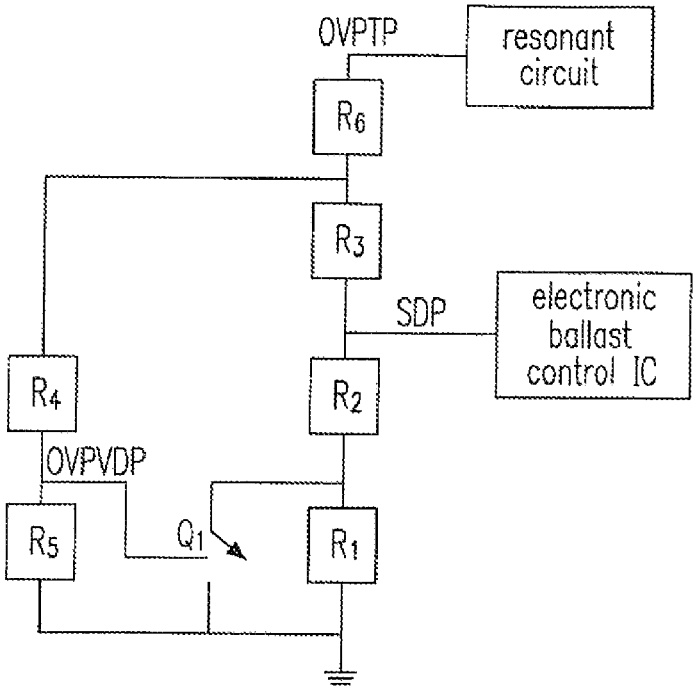
Figure 7D:
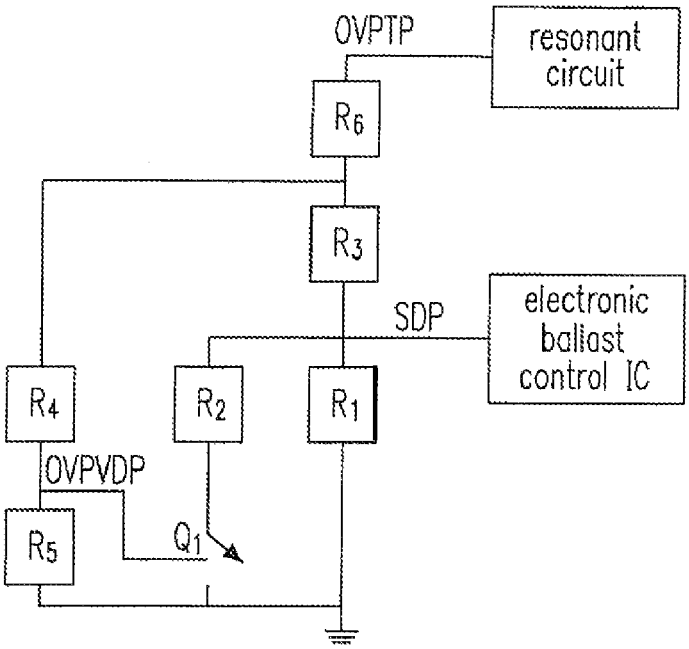
Figure 7E:
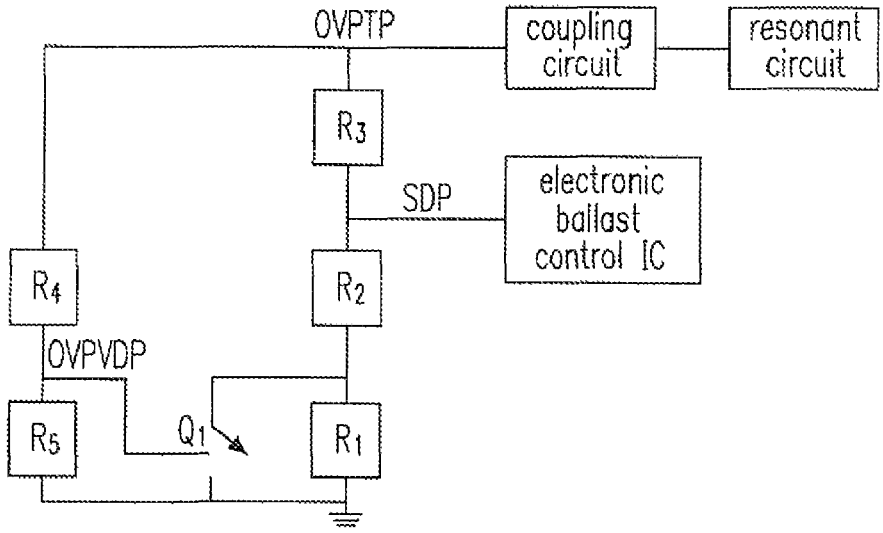
Figure 7F:
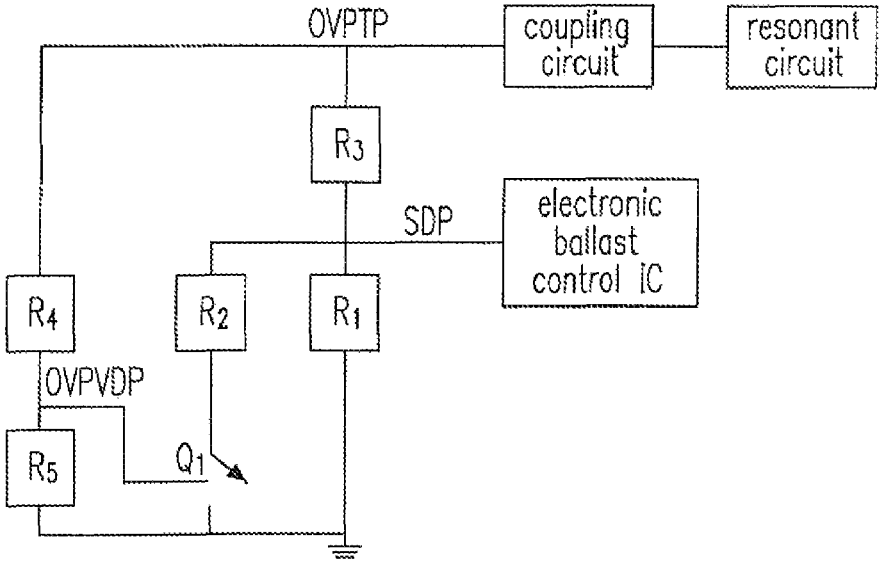
Figure 7G:
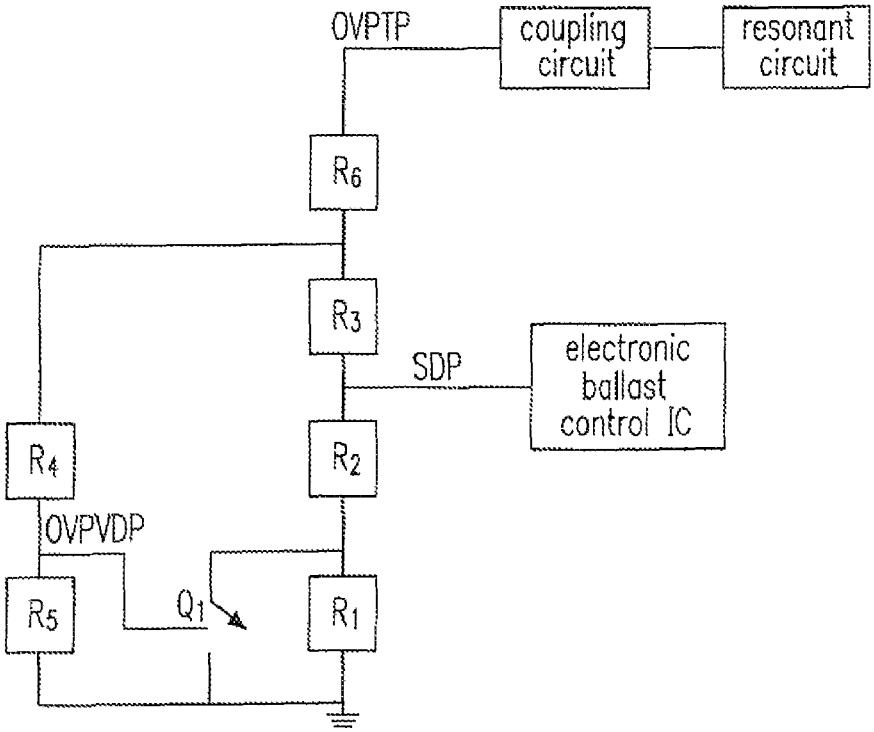
Figure 7H:
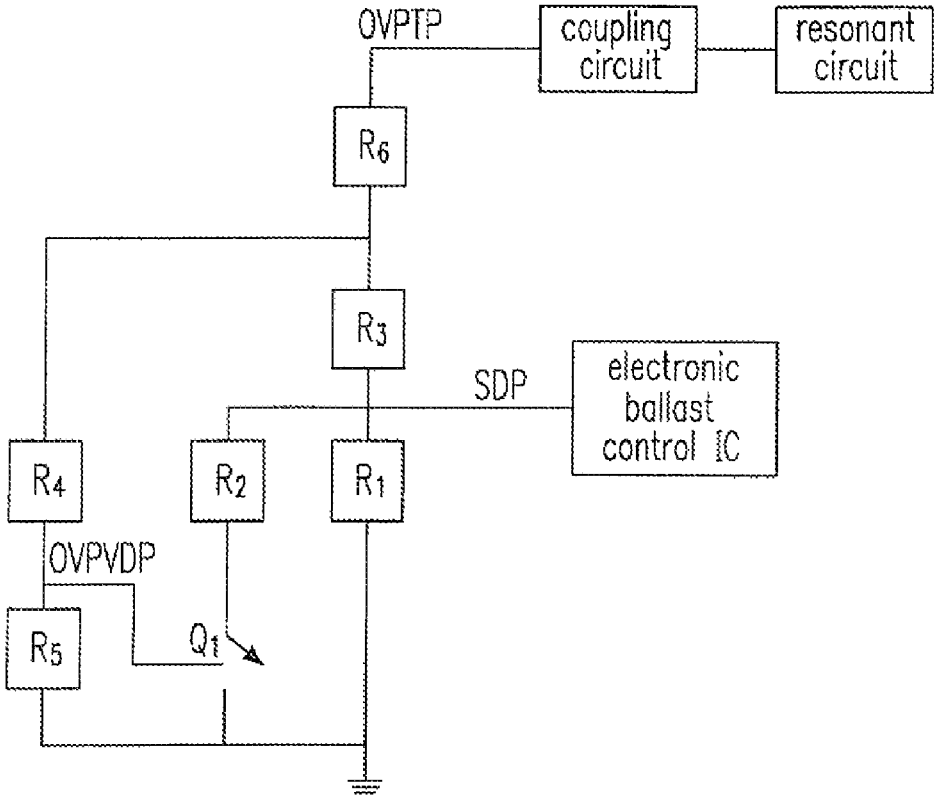

The electronic ballast having an end of lamp life protection circuit with bi-level detecting signal proposed in the present invention, the characteristics of which are detecting the lamp tube combination to control a detecting switch so as to change a detecting value of the end of lamp life protection voltage to achieve the purposes of end of lamp life protection for the applications of various lamp powers or multiple lamp tubes connected in series.

FIGS. 7(*a*) to 7(*h*) respectively show a schematic circuit diagram of an electronic ballast having an end of lamp life protection circuit with bi-level detecting signal according to the first to the eighth preferred embodiments of the present invention. The change of the detecting value of the shutdown pin (SDP) of the control IC of the electronic ballast can be realized either by a connected in series configuration (as shown in FIG. 7(*a*)) or by a connected in parallel configuration (as shown in FIG. 7(*b*)). In FIG. 7(*a*), it discloses an end of lamp life protection circuit configured in a ballast, it is an end of lamp life protection circuit having a bi-level detecting signal, provides a function of over voltage protection (OVP), comprises a voltage dividing circuit having an input terminal OVPTP (OVP test point), a first output terminal SDP (Shutdown Pin) and a second output terminal OVP voltage dividing point (OVPVDP), the input terminal receives an input voltage, the first output terminal outputs a first divided voltage, and the second output terminal outputs a second divided voltage, and a switch apparatus (Q1+R1/R2+the first output terminal+the controller of the electronic ballast, it is a control IC of the electronic ballast). The first divided voltage is raised when the second divided voltage is smaller than a first predetermined threshold value, and the ballast is turned off via the first divided voltage output from the first output terminal and the controller of the electronic ballast when the first divided voltage is higher than a second predetermined threshold value.

The voltage-dividing circuit further comprises a first, a second, a third, a fourth and a fifth resistors (R1-R5) and a first and a second voltage-dividing routes, the switch apparatus comprises a switch Q1 and the first resistor R1, the switch Q1 is turned off such that the first voltage-dividing route is electrically connected to the input terminal, the third resistor R3, the first output terminal, the second resistor R2, the first resistor R1 and a grounded terminal in series so as to raise the first divided voltage when the second divided voltage is smaller than the first predetermined threshold value, and the switch Q1 is turned on and the first resistor R1 is short-circuited such that the first voltage-dividing route is electrically connected to the input terminal, the third resistor R3, the first output terminal, the second resistor R2 and the grounded terminal so that the first divided voltage is prohibited being raised when the second divided voltage is not smaller than the first predetermined threshold value. The second voltage-dividing route is electrically connected to the input terminal, the fourth resistor R4, the second output terminal, the fifth resistor R5 and the grounded terminal in series for generating the second divided voltage, the switch Q1 comprises a first terminal coupled to the first and the second resistors R1+R2, a second terminal coupled to the grounded terminal and a control terminal coupled to the second output terminal.

The difference between FIG. 7(*b*) and FIG. 7(*a*) is that the change of the detecting value of the shutdown pin of the control IC of the electronic ballast is realized by a connected in parallel configuration. The switch Q1 is turned off such that the first voltage-dividing route is electrically connected to the input terminal, the third resistor R3, the first output terminal, the first resistor R1 and a grounded terminal in series so as to raise the first divided voltage when the second divided voltage is smaller than the first predetermined threshold value, and the switch Q1 is turned on such that the first voltage-dividing route is electrically connected to the input terminal, the third resistor R3, the first output terminal, the first and the second resistors R1+R2 connected to each other in parallel and the grounded terminal so that the first divided voltage is prohibited being raised when the second divided voltage is not smaller than the first predetermined threshold value.

FIG. 7(*c*) and FIG. 7(*d*) are the improvements of FIG. 7(*a*) and FIG. 7(*b*), the two detecting routes of resistors go through OVPTP, a sixth resistor R6 is coupled between OVPTP and the first and the second voltage-dividing routes. FIGS. 7(*e*), 7(*f*), 7(*g*) and 7(*h*) are circuit transformations of FIGS. 7(*a*), 7(*b*), 7(*c*) and 7(*d*) respectively, and the voltage of OVPTP is originally taken from the resonant circuit and has been changed to be taken from the coupling circuit coupled to the resonant circuit. Surely, the voltage of the OVPTP could also be taken respectively from the resonant circuit and the coupling circuit coupled to the resonant circuit so that the application circuit could be further extended.

Figure 8:
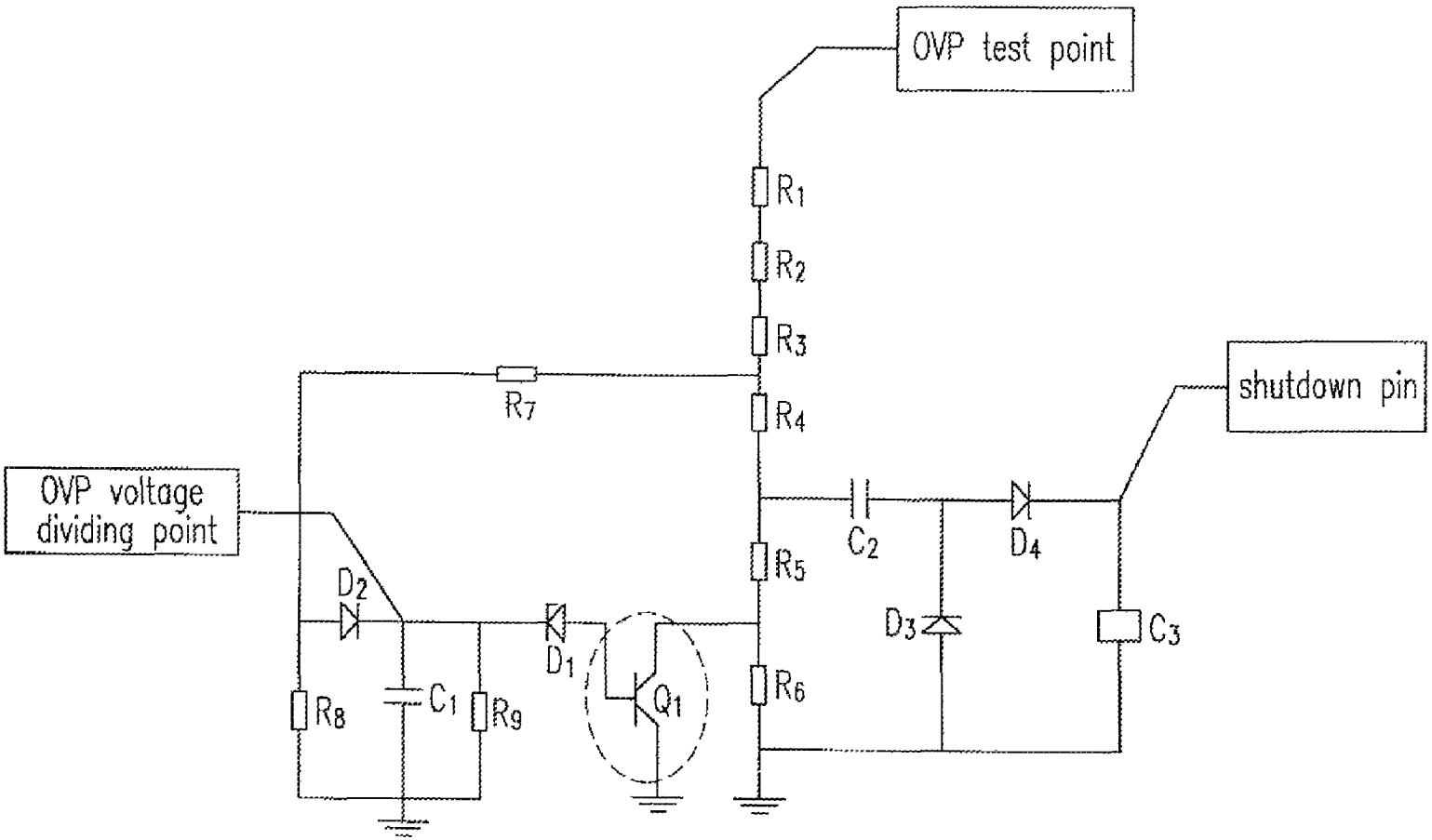
FIG. 8 shows a schematic circuit diagram of a real design circuit according to FIG. 7(*c*), which can be applied to electronic ballasts of T2 6 W to 23 W.

FIG. 8 is the real design circuit of FIG. 7(*c*) and can be applied to electronic ballasts of T2 6 W to 23 W (wherein the OVP test point is the OVPTP, and the OVP voltage dividing point is the OVPVDP). The parameters of elements are as follows:

| | | | | |
|---|---|---|---|---|
| R1 = 200 Kohm | R2 = 200 Kohm | R3 = 200 Kohm | R4 = 200 Kohm | R5 = 14 Kohm |
| R6 = 29.4 Kohm | R7 = 365 Kohm | R8 = 1 Mohm | R9 = 511 Kohm | C1 = 0.47 uF |
| C2 = 330 pF | C3 = 0.22 uF | D1 = 12 V Zener | D2 = 1N4148 | D3 = 1N4148 |
| D4 = 1N4148 | Q1 = 2N4401TA | | | |

Collocating the predetermined detecting value of 3V of the SD/EOL pin of the IC IRS2168DSPbF of the International Rectifier Corp., the OVP test point detects a relatively higher voltage when the load is 23 W and 21 W lamp tubes, the voltage is divided through R1, R2, R3, R7 and R8, D2 and C1 are used to engage in the half-wave rectification, an energy is stored on C1, Q1 is turned on when the voltage across C1 is higher than that of D1 and R6 is further short-circuited. The OVP test point detects a relatively lower voltage when the load is 13 W, 11 W, 8 W and 6 W lamp tubes, the voltage is divided through R1, R2, R3, R7 and R8, D2 and C1 are used to engage in the half-wave rectification, an energy is stored on C1, Q1 is kept as turn-off when the voltage across C1 is lower than that of D1 and R6 is unchanged. Whether D1 is turned on or not is decided by the voltage difference of the lamp tubes of 21 W and 13 W. The voltage of the 21 W lamp tube is 210V, and the voltage of the 13 W lamp tube is 133V. D1 could be a zener diode as shown in FIG. 8, or it could be a DIAC. The voltage is divided through another route of the OVP test point, R1, R2, R3, R4, R5 and R6, the DC component is filtered via C2, D3 is used to get rid of the negative voltage, D4 and C3 are used to engage in the half-wave rectification to filter the wave and get a DC signal. This DC signal is compared with that of the SD/EOL pin, and the electronic ballast will enter the protection mode and is turned off when the DC signal is higher than 3V.

Figure 9A:
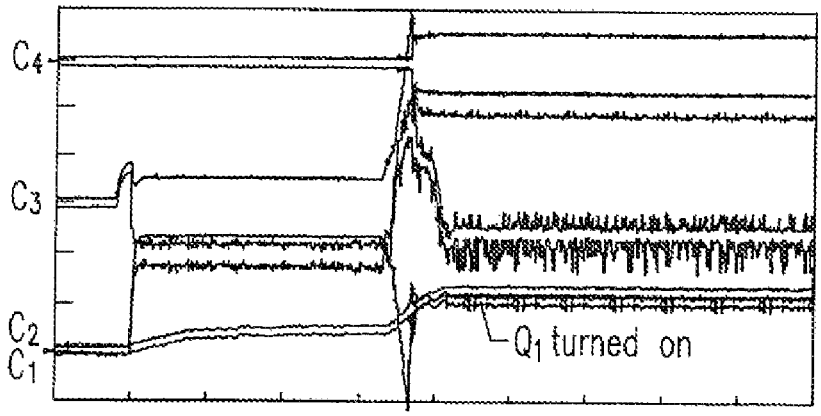
FIGS. 9(*a*) and 9(*b*) are respectively the measuring waveforms of the load lamps of 23 W and 6 W.
Figure 9B:
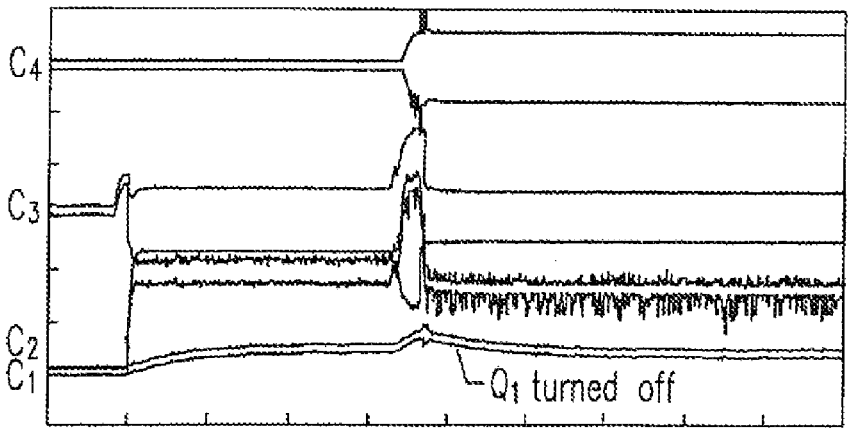
Figure 10:
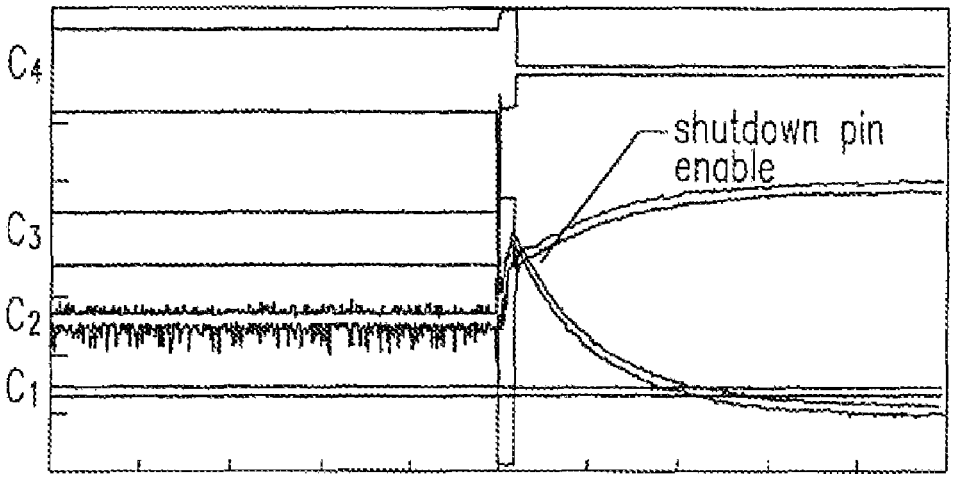
FIG. 10 shows the waveform diagram of the shutdown/EOL pin of a specific control chip of an electronic ballast.

FIGS. 9(*a*) and 9(*b*) are respectively the measuring waveforms of the load lamps of 23 W and 6 W. In FIGS. 9(*a*) and 9(*b*), C1 is the waveform diagram of the OVPVDP, C2 is the waveform diagram of the shutdown pin, C3 is the waveform diagram of the OVPTP, and C4 is the waveform diagram of the lamp current. When the 23 W load lamp is lit-up, Q1 is turned on and decreases the voltage of SD/EOL pin of C2 to 2.4V, under the condition of 6 W, Q1 is not taken any action, the voltage of SD/EOL pin is 1.6V. Using the testing condition of EOL under the safety regulation of IEC61347-2-3 to evaluate, the waveform of SD/EOL is shown in FIG. 10, and the electronic ballast will enter the protection mode and is turned off when the voltage of which is higher than 3V. In FIG. 10, C1 is the waveform of shutdown pin, C2 is the waveform of OVPVDP, C3 is the waveform of OVPTP and C4 is the waveform of lamp current.

Experiments prove that the drawbacks in the prior art could be solved by the present invention, and the application conditions of the various lamp loads with the same current and various powers are fulfilled.

Figure 11:
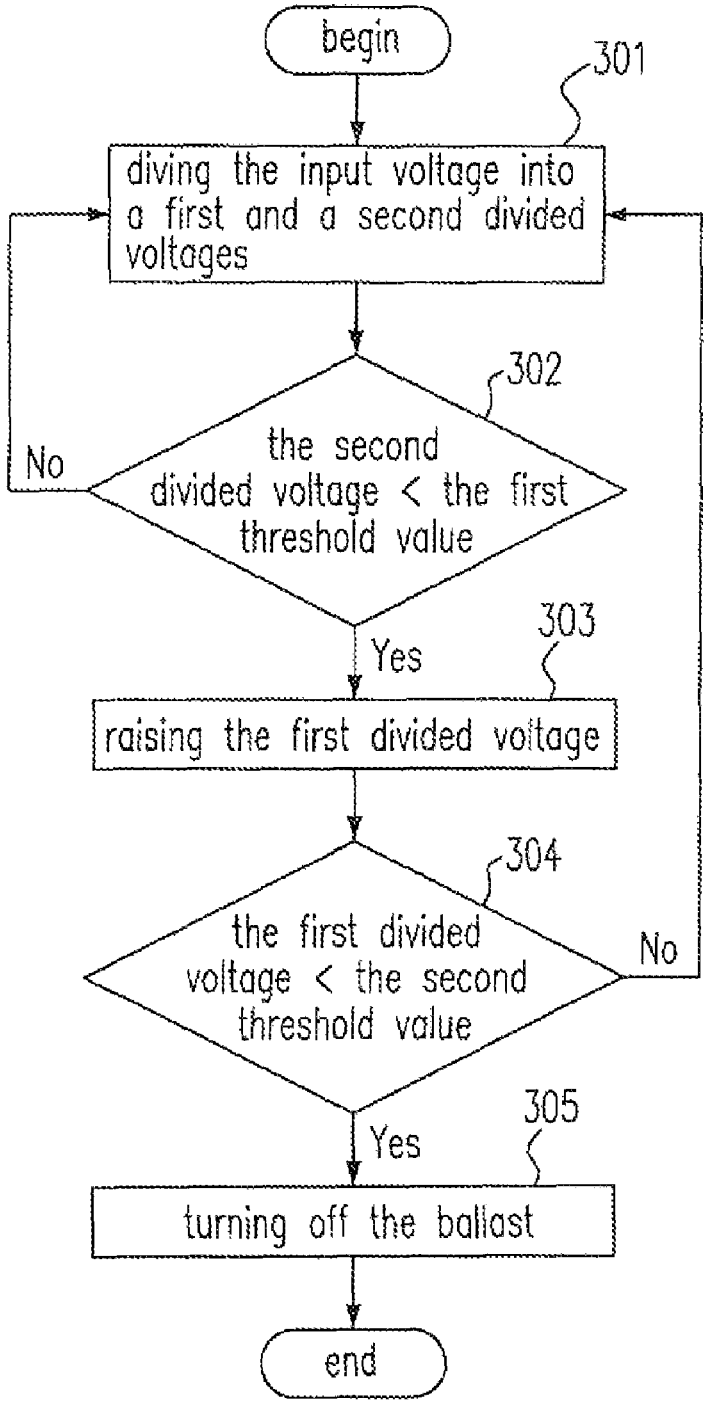
FIG. 11 shows a flow chart of a controlling method for an electronic ballast having end of lamp life protection circuit with bi-level detecting signal according to the first to the eighth preferred embodiments of the present invention.

Please refer to FIG. 11, it shows a flow chart of a controlling method for an electronic ballast having end of lamp life protection circuit with bi-level detecting signal according to the first to the eighth preferred embodiments of the present invention. In FIG. 11, the input voltage is divided into a first and a second divided voltages in the step 301 firstly. And then, it judges whether the second divided voltage is smaller than a first (predetermined) threshold value in the step 302. When the second divided voltage is smaller than a first (predetermined) threshold value, it goes to the step 303, which causes the first divided voltage to be raised, and when the second divided voltage is larger than or equal to the first (predetermined) threshold value, it goes back to step 301. Then, it goes to step 304, it judges whether the first divided voltage is larger than a second (predetermined) threshold value. When the first divided voltage is larger than the second (predetermined) threshold value, it goes to step 305, the ballast is turned off, and when the first divided voltage is smaller than or equal to the second (predetermined) threshold value, it goes back to step 301.

In the above-mentioned controlling method, the ballast is operated under a protection mode when the first divided voltage is higher than the second predetermined threshold value. The step 302 further comprises the following steps: providing a voltage-dividing circuit having a resistor and a first and a second voltage-dividing routes and a switch apparatus having a switch and the resistor; turning off the switch to electrically connect the resistor and the first voltage-dividing route in series so as to raise the first divided voltage when the second divided voltage provided by the second voltage-dividing route is smaller than the first predetermined threshold value; and turning on the switch to short-circuit the resistor so that the first divided voltage is prohibited being raised when the second divided voltage is not smaller than the first predetermined threshold value.

Furthermore, the aforementioned step 304 further comprises the following steps: providing a controller of a ballast; and turning off the ballast via the controller of the ballast when the first divided voltage is higher than the second predetermined threshold value.

Besides, the above-mentioned step 302 further comprises the following steps: providing a voltage-dividing circuit having a first and a second resistors and a first and a second voltage-dividing routes, and a switch apparatus having a switch and the second resistor; turning off the switch to electrically connect the first resistor and the first voltage-dividing route in series so as to raise the first divided voltage when the second divided voltage provided by the second voltage-dividing route is smaller than the first predetermined threshold value; and turning on the switch to electrically connect the first and the second resistors connected to each other in parallel and the first voltage-dividing route in series so that the first divided voltage is prohibited being raised when the second divided voltage is not smaller than the first predetermined threshold value.

According to the aforementioned descriptions, the present invention provides an electronic ballast having an end of lamp life protection circuit with bi-level detecting signals to improve the quality of the electronic ballast to avoid the melting of the lamp socket caused by the over-heating of the filament so as to prevent a fire, which indeed possesses the non-obviousness and the novelty.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. An end of lamp life protection circuit configured in a ballast, comprising:

a voltage-dividing circuit having an input terminal receiving an input voltage, a first output terminal outputting a first divided voltage and a second output terminal outputting a second divided voltage; and a switch apparatus raising the first divided voltage when the second divided voltage is less than a first predetermined threshold value and turning off the ballast when the first divided voltage is higher than a second predetermined threshold value.

2. A circuit according to claim 1, wherein the voltage-dividing circuit further comprises a first, a second, a third, a fourth and a fifth resistors and a first voltage-dividing route, the switch apparatus comprises a switch and the first resistor, the switch is turned off such that the first voltage-dividing route is electrically connected to the input terminal, the third resistor, the first output terminal, the second resistor, the first resistor and a grounded terminal in series so as to raise the first divided voltage when the second divided voltage is smaller than the first predetermined threshold value, and the switch is turned on and the first resistor is short-circuited such that the first voltage-dividing route is electrically connected to the input terminal, the third resistor, the first output terminal, the second resistor and the grounded terminal so that the first divided voltage is prohibited being raised when the second divided voltage is not smaller than the first predetermined threshold value.

3. A circuit according to claim 2, wherein the voltage-dividing circuit further comprises a second voltage-dividing route electrically connected to the input terminal, the fourth resistor, the second output terminal, the fifth resistor and the grounded terminal in series for generating the second divided voltage, the switch comprises a first terminal coupled to the first and the second resistors, a second terminal coupled to the grounded terminal and a control terminal coupled to the second output terminal.

4. A circuit according to claim 2, wherein the switch apparatus further comprises a control device coupled to the control terminal of the switch and the second output terminal, the control device is turned off so as to turn off the switch when the second divided voltage is smaller than the first predetermined threshold value, and the control device is turned on so as to turn on the switch when the second divided voltage is not smaller than the first predetermined threshold value.

5. A circuit according to claim 4, wherein the control device is one of a zener diode and a DIAC, and the first predetermined threshold value is a breakdown voltage of one of the zener diode and the DIAC.

6. A circuit according to claim 1, wherein the voltage-dividing circuit further comprises a first, a second, a third, a fourth and a fifth resistors and a first voltage-dividing route, the switch apparatus comprises a switch and the second resistor, the switch is turned off such that the first voltage-dividing route is electrically connected to the input terminal, the third resistor, the first output terminal, the first resistor and a grounded terminal in series so as to raise the first divided voltage when the second divided voltage is smaller than the first predetermined threshold value, and the switch is turned on such that the first voltage-dividing route is electrically connected to the input terminal, the third resistor, the first output terminal, the first and the second resistors connected to each other in parallel and the grounded terminal so that the first divided voltage is prohibited being raised when the second divided voltage is not smaller than the first predetermined threshold value.

7. A circuit according to claim 6, wherein the voltage-dividing circuit further comprises a second voltage-dividing route electrically connected to the input terminal, the fourth resistor, the second output terminal, the fifth resistor and the grounded terminal in series for generating the second divided voltage, and the switch comprises a first terminal coupled to the second resistor, a second terminal coupled to the grounded terminal and a control terminal coupled to the second output terminal.

8. A circuit according to claim 1, wherein the voltage-dividing circuit further comprises a first, a second, a third, a fourth, a fifth and a sixth resistors and a first voltage-dividing route, the switch apparatus comprises a switch and the first resistor, the switch is turned off such that the first voltage-dividing route is electrically connected to the input terminal, the sixth resistor, the third resistor, the first output terminal, the second resistor, the first resistor and a grounded terminal in series so as to raise the first divided voltage when the second divided voltage is smaller than the first predetermined threshold value, and the switch is turned on and the first resistor is short-circuited such that the first voltage-dividing route is electrically connected to the input terminal, the sixth resistor, the third resistor, the first output terminal, the second resistor and the grounded terminal so that the first divided voltage is prohibited being raised when the second divided voltage is not smaller than the first predetermined threshold value.

9. A circuit according to claim 8, wherein the voltage-dividing circuit further comprises a second voltage-dividing route electrically connected to the input terminal, the sixth resistor, the fourth resistor, the second output terminal, the fifth resistor and the grounded terminal in series for generating the second divided voltage, the switch comprises a first terminal coupled to the first and the second resistors, a second terminal coupled to the grounded terminal and a control terminal coupled to the second output terminal.

10. A circuit according to claim 1, wherein the voltage-dividing circuit further comprises a first, a second, a third, a fourth, a fifth and a sixth resistors and a first voltage-dividing route, the switch apparatus comprises a switch and the second resistor, the switch is turned off such that the first voltage-dividing route is electrically connected to the input terminal, the sixth resistor, the third resistor, the first output terminal, the first resistor and a grounded terminal in series so as to raise the first divided voltage when the second divided voltage is smaller than the first predetermined threshold value, and the switch is turned on such that the first voltage-dividing route is electrically connected to the input terminal, the sixth resistor, the third resistor, the first output terminal, the first and the second resistors connected to each other in parallel and the grounded terminal so that the first divided voltage is prohibited being raised when the second divided voltage is not smaller than the first predetermined threshold value.

11. A circuit according to claim 10, wherein the voltage-dividing circuit further comprises a second voltage-dividing route electrically connected to the input terminal, the sixth resistor, the fourth resistor, the second output terminal, the fifth resistor and the grounded terminal in series for generating the second divided voltage, and the switch comprises a first terminal coupled to the second resistor, a second terminal coupled to the grounded terminal and a control terminal coupled to the second output terminal.

12. A circuit according to claim 1, wherein the ballast further comprises a resonant circuit and a controller of the ballast, the input terminal is coupled to the resonant circuit, the switch apparatus comprises the controller of the ballast and the first output terminal coupled to the controller of the ballast, and the ballast is turned off via the controller of the ballast when the first divided voltage is higher than the second predetermined threshold value.

13. A circuit according to claim 1, wherein the ballast further comprises a coupling circuit, a resonant circuit and a controller of the ballast, the input terminal is coupled to the coupling circuit coupled to the resonant circuit, the switch apparatus comprises the controller of the ballast and the first output terminal coupled to the controller of the ballast, and the ballast is turned off via the controller of the ballast when the first divided voltage is higher than the second predetermined threshold value.

14. A circuit according to claim 1, wherein the ballast is an electronic ballast and configured in a specific flourescent lamp, and the specific flourescent lamp is one selected from a group consisting of a plurality of flourescent lamps, each of which has an equal current value and a power value different from one another.

15. A controlling method for an end of lamp life protection circuit configured in a ballast, wherein the end of lamp life protection circuit is operated under an input voltage, the method comprising the steps of:

dividing the input voltage into a first and a second divided voltages;

raising the first divided voltage when the second divided voltage is smaller than a first predetermined threshold value; and turning off the ballast when the first divided voltage is higher than a second predetermined threshold value.

16. A method according to claim 15, wherein the ballast is operated under a protection mode when the first divided voltage is higher than the second predetermined threshold value.

17. A method according to claim 15, wherein the raising the first divided voltage step further comprises the following steps:

providing a voltage-dividing circuit having a resistor and a first and a second voltage-dividing routes and a switch apparatus having a switch and the resistor;

turning off the switch to electrically connect the resistor and the first voltage-dividing route in series so as to raise the first divided voltage when the second divided voltage provided by the second voltage-dividing route is smaller than the first predetermined threshold value; and turning on the switch to short-circuit the resistor so that the first divided voltage is prohibited being raised when the second divided voltage is not smaller than the first predetermined threshold value.

18. A method according to claim 15, wherein the raising the first divided voltage step further comprises the following steps:

providing a controller of a ballast; and turning off the ballast via the controller of the ballast when the first divided voltage is higher than the second predetermined threshold value.

19. A method according to claim 15, wherein the raising the first divided voltage step further comprises the following steps:

providing a voltage-dividing circuit having a first and a second resistors and a first and a second voltage-dividing routes, and a switch apparatus having a switch and the second resistor;

turning off the switch to electrically connect the first resistor and the first voltage-dividing route in series so as to raise the first divided voltage when the second divided voltage provided by the second voltage-dividing route is smaller than the first predetermined threshold value; and turning on the switch to electrically connect the first and the second resistors connected to each other in parallel and the first voltage-dividing route in series so that the first divided voltage is prohibited being raised when the second divided voltage is not smaller than the first predetermined threshold value.

* * * * *